US009295882B2

(12) United States Patent
Sullivan et al.

(10) Patent No.: US 9,295,882 B2
(45) **Date of Patent: *Mar. 29, 2016**

(54) GOLF BALL HAVING A TRANSLUCENT LAYER CONTAINING FIBER FLOCK

(71) Applicant: Acushnet Company, Fairhaven, MA (US)

(72) Inventors: Michael J. Sullivan, Old Lyme, CT (US); William E. Morgan, Barrington, RI (US)

(73) Assignee: Acushnet Company, Fairhaven, MA (US)

( * ) Notice: Subject to any disclaimer, the term of this patent is extended or adjusted under 35 U.S.C. 154(b) by 184 days.

This patent is subject to a terminal disclaimer.

(21) Appl. No.: 14/021,818

(22) Filed: Sep. 9, 2013

(65) Prior Publication Data

US 2014/0045612 A1 Feb. 13, 2014

Related U.S. Application Data

(60) Continuation-in-part of application No. 13/309,085, filed on Dec. 1, 2011, now Pat. No. 8,529,378, which is a division of application No. 12/143,879, filed on Jun. 23, 2008, now Pat. No. 8,070,626, which is a continuation-in-part of application No. 11/707,493, filed on Feb. 16, 2007, now Pat. No. 7,722,483.

(51) Int. Cl.
*A63B 37/06* (2006.01)
*A63B 37/00* (2006.01)
(Continued)

(52) U.S. Cl.
CPC ..... *A63B 37/0039* (2013.01); *A63B 37/0024* (2013.01); *A63B 37/0027* (2013.01); *A63B 37/0051* (2013.01); *A63B 37/0074* (2013.01); *A63B 37/0075* (2013.01); *A63B 37/0076* (2013.01); *A63B 37/0093* (2013.01);
(Continued)

(58) Field of Classification Search
CPC ..... A63B 37/0039
USPC ..... 473/373, 374
See application file for complete search history.

(56) References Cited

U.S. PATENT DOCUMENTS 2,809,954 A 10/1957 Kazenas
2,851,424 A 9/1958 Switzer et al.
(Continued)

FOREIGN PATENT DOCUMENTS

JP 2001-087423 4/2001

OTHER PUBLICATIONS

Mark S. Murphy; "Just Different Enough" Golf World Business; Apr. 18, 2005; p. 2.
(Continued)

*Primary Examiner* — Raeann Gorden
(74) *Attorney, Agent, or Firm* — Daniel W. Sullivan

(57) ABSTRACT

A golf ball having at least a core and a composite layer comprising a fibrous material and a matrix material is provided. The matrix material preferably comprises a translucent polymer. Preferably, the fibrous material comprises fiber flock. Preferably, the fiber flock comprises fiber segments having a length less than one inch. The fiber segments may have substantially equal dimensions. In other instances, the fiber segments are of unequal dimensions. The golf balls preferably includes a translucent cover layer surrounding the composite layer and an intermediate layer disposed between the composite layer and the core.

16 Claims, 4 Drawing Sheets

(51) Int. Cl.
*A63B 43/00* (2006.01)
*A63B 45/00* (2006.01)

(52) U.S. Cl.
CPC ..... *A63B43/008* (2013.01); *A63B 45/00* (2013.01); *A63B 2209/02* (2013.01)

(56) References Cited

U.S. PATENT DOCUMENTS

| | | | |
|---|---|---|---|
| 2,938,873 | A | 5/1960 | Kazenas |
| 3,253,146 | A | 5/1966 | de Vries |
| 3,412,036 | A | 11/1968 | McIntosh |
| D228,394 | S | 9/1973 | Martin et al. |
| 3,888,207 | A | 6/1975 | Stutz et al. |
| 3,989,568 | A | 11/1976 | Isaac |
| 4,123,061 | A | 10/1978 | Dusbiber |
| 4,128,600 | A | 12/1978 | Skinner et al. |
| 4,238,526 | A | 12/1980 | Chitouras |
| 4,317,933 | A | 3/1982 | Parker |
| 4,342,793 | A | 8/1982 | Skinner et al. |
| 4,560,168 | A | 12/1985 | Aoyama |
| 4,679,795 | A | 7/1987 | Melvin et al. |
| 4,798,386 | A | 1/1989 | Berard |
| 4,804,189 | A | 2/1989 | Gobush |
| 4,921,759 | A | 5/1990 | Orain et al. |
| 4,925,193 | A | 5/1990 | Melvin et al. |
| 4,950,696 | A | 8/1990 | Palazotto et al. |
| 4,960,281 | A | 10/1990 | Aoyama |
| 4,985,340 | A | 1/1991 | Palazzotto et al. |
| 4,991,852 | A | 2/1991 | Pattison |
| 4,998,734 | A | 3/1991 | Meyer |
| 5,000,458 | A | 3/1991 | Proudfit |
| 5,018,742 | A | 5/1991 | Isaac et al. |
| 5,143,377 | A | 9/1992 | Oka et al. |
| 5,147,900 | A | 9/1992 | Palazzotto et al. |
| 5,156,405 | A | 10/1992 | Kitaoh et al. |
| 5,249,804 | A | 10/1993 | Sanchez |
| 5,256,170 | A | 10/1993 | Harmer et al. |
| 5,263,233 | A | 11/1993 | Kim et al. |
| 5,326,621 | A | 7/1994 | Palazzotto et al. |
| 5,334,673 | A | 8/1994 | Wu |
| 5,360,462 | A | 11/1994 | Harmer et al. |
| 5,376,428 | A | 12/1994 | Palazzotto et al. |
| 5,427,378 | A | 6/1995 | Murphy |
| 5,442,680 | A | 8/1995 | Schellinger et al. |
| 5,484,870 | A | 1/1996 | Wu |
| 5,494,291 | A | 2/1996 | Kennedy |
| 5,562,552 | A | 10/1996 | Thurman |
| 5,575,477 | A | 11/1996 | Hwang |
| 5,605,761 | A | 2/1997 | Burns et al. |
| 5,672,643 | A | 9/1997 | Burns et al. |
| 5,674,622 | A | 10/1997 | Burns et al. |
| 5,688,191 | A | 11/1997 | Cavallaro et al. |
| 5,692,974 | A | 12/1997 | Wu et al. |
| 5,713,801 | A | 2/1998 | Aoyama |
| 5,783,293 | A | 7/1998 | Lammi |
| 5,800,286 | A | 9/1998 | Kakiuchi et al. |
| 5,803,831 | A | 9/1998 | Sullivan et al. |
| 5,820,488 | A | 10/1998 | Sullivan et al. |
| 5,823,890 | A | 10/1998 | Maruko et al. |
| 5,823,891 | A | 10/1998 | Winskowicz |
| 5,840,788 | A | 11/1998 | Lutz et al. |
| 5,885,172 | A | 3/1999 | Hebert et al. |
| 5,900,439 | A | 5/1999 | Prissok et al. |
| 5,902,191 | A | 5/1999 | Masutani et al. |
| 5,919,100 | A | 7/1999 | Boehm et al. |
| 5,929,189 | A | 7/1999 | Ichikawa et al. |
| 5,938,544 | A | 8/1999 | Winskowicz |
| 5,957,786 | A | 9/1999 | Aoyama |
| 5,957,787 | A | 9/1999 | Hwang |
| 5,965,669 | A | 10/1999 | Cavallaro et al. |
| 5,981,654 | A | 11/1999 | Rajagopalan |
| 5,981,658 | A | 11/1999 | Rajagopalan |
| 5,989,135 | A | 11/1999 | Welch |
| 5,993,968 | A | 11/1999 | Umezawa et al. |
| 6,056,842 | A | 5/2000 | Dalton et al. |
| 6,083,119 | A | 7/2000 | Sullivan et al. |
| 6,120,394 | A | 9/2000 | Kametani |
| 6,149,535 | A | 11/2000 | Bissonnette et al. |
| 6,152,834 | A | 11/2000 | Sullivan |
| 6,200,232 | B1 | 3/2001 | Kasashima et al. |
| 6,207,784 | B1 | 3/2001 | Rajagopalan |
| 6,214,141 | B1 | 4/2001 | Kim et al. |
| 6,251,991 | B1 | 6/2001 | Takesue et al. |
| 6,277,037 | B1 | 8/2001 | Winskowicz et al. |
| 6,358,160 | B1 | 3/2002 | Winskowicz |
| 6,369,125 | B1 | 4/2002 | Nesbitt |
| 6,450,902 | B1 | 9/2002 | Hwang |
| 6,548,618 | B2 | 4/2003 | Sullivan et al. |
| 6,558,227 | B1 | 5/2003 | Kodaira et al. |
| 6,565,455 | B2 | 5/2003 | Hayashi |
| 6,565,456 | B2 | 5/2003 | Hayashi |
| 6,790,149 | B2 | 9/2004 | Kennedy et al. |
| 6,824,476 | B2 | 11/2004 | Sullivan et al. |
| 6,846,879 | B2 | 1/2005 | Iwami |
| 6,872,154 | B2 | 3/2005 | Shannon et al. |
| 6,949,595 | B2 | 9/2005 | Morgan et al. |
| 7,090,798 | B2 | 8/2006 | Hebert et al. |
| 7,191,549 | B2 | 3/2007 | Koo |
| 7,291,076 | B2 | 11/2007 | Watababe |
| 7,879,392 | B2 | 2/2011 | Wenzel et al. |
| 8,070,626 | B2 * | 12/2011 | Morgan ..... 473/378 |
| 8,529,378 | B2 * | 9/2013 | Morgan ..... 473/378 |
| 2002/0045501 | A1 | 4/2002 | Takemura et al. |
| 2002/0086743 | A1 | 7/2002 | Bulpett |
| 2004/0176184 | A1 | 9/2004 | Morgan et al. |
| 2004/0176185 | A1 | 9/2004 | Morgan et al. |
| 2004/0176188 | A1 | 9/2004 | Morgan et al. |
| 2005/0148409 | A1 | 7/2005 | Morgan et al. |
| 2005/0197211 | A1 | 9/2005 | Sullivan et al. |

OTHER PUBLICATIONS

Wilson Hope golf ball, http://www.pargolf.com/products/Wilson-Hope.htm, Jan. 27, 2005.
Color photographs of Volvik "Crystal" golf ball and packaging, 2005.
Volvik Crystal golf ball, http://www.volvik.co.kr/english/product/crystal.asp, Jan. 21, 2005.
Volvik Golf Ball Brochure, 2005, pp. 1, 16-17 and 24.
Color photographs of Volvik "Crystal" golf ball, 2004.
Color photographs of Wilson "iWound", display model only with clear cover, 2001.
"Urea", Kirk-Othmer Encyclopedia of Chemical Technology. John Wiley & Sons, Inc. copyright 1998.
Color Photographs of Wilson "Quantum" golf ball, late 1990s.
Color Photographs of Pro Keds "Crystal π" golf ball, 1980's.
"Optical brightener" in Kirk-Othmer, Encyclopedia of Chemical Technology, 3d Edition, vol. 4, pp. 213.

* cited by examiner

GOLF BALL HAVING A TRANSLUCENT LAYER CONTAINING FIBER FLOCK

CROSS REFERENCE TO RELATED APPLICATIONS

This application is a continuation-in-part of co-assigned U.S. patent application Ser. No. 13/309,085 filed on Dec. 1, 2011, now allowed, which is divisional of U.S. patent application Ser. No. 12/143,879, filed on Jun. 23, 2008, now U.S. Pat. No. 8,070,626, which is a continuation-in-part of U.S. patent application Ser. No. 11/707,493, filed on Feb. 16, 2007, now U.S. Pat. No. 7,722,483, the entire disclosures of which are hereby incorporated by reference.

BACKGROUND OF THE INVENTION

1. Field of the Invention

The invention relates to golf balls, and more particularly, the invention is directed to golf balls with a translucent cover wherein visible fibrous elements are dispersed in the translucent cover, one or more intermediate layers, or both.

2. Brief Review of the Related Art

Golf balls, whether of solid or wound construction, generally include a core and a cover. It is known in the art to modify the properties of a conventional solid ball by altering the typical single layer core and single cover layer construction to provide a ball having at least one mantle layer disposed between the cover and the core. The core may be solid or liquid-filled, and may be formed of a single layer or one or more layers. Covers, in addition to cores, may also be formed of one or more layers. These multi-layer cores and covers are sometimes known as "dual core" and "dual cover" golf balls, respectively. Additionally, many golf balls contain one or more intermediate layers that can be of solid construction or, in many cases, be formed of a tensioned elastomeric winding, which are referred to as wound balls. The difference in play characteristics resulting from these different types of constructions can be quite significant. The playing characteristics of multi-layer balls, such as spin and compression, can be tailored by varying the properties of one or more of these intermediate and/or cover layers.

Another type of ball has evolved which employs a very large core and a very thin layer of elastic windings that forms a hoop-stress layer. In many golf balls, the ball diameter is about 1.68 inches. In such golf balls with a large core, the core has a diameter of between 1.50 and 1.63 inches. In such golf balls, the thickness of the thin wound layer is between 0.01 and 0.10 inches. In one example, the large core includes a center and a layer of conventional windings subsequently wound with threads that form a hoop-stress layer. The hoop-stress layer aids in rapidly returning the core to its spherical shape, and is a separate layer from the cover or core. The hoop-stress layer has about the same thickness as inner cover layers on many double-cover designs. Though most of the ball's resiliency comes from the core, the contribution of the wound hoop-stress layer to resiliency is significant.

Manufacturers generally provide the golf ball with a durable cover material, such as an ionomer resin, or a softer cover material, such as polyurethane or polyurea. Chemically, ionomer resins are a copolymer of an olefin and an $\alpha,\beta$-ethylenically-unsaturated carboxylic acid having 10-90 percent of the carboxylic acid groups neutralized by a metal ion and are distinguished by the type of metal ion, the amount of acid, and the degree of neutralization. Commercially available ionomer resins include copolymers of ethylene and methacrylic or acrylic acid neutralized with metal salts.

Examples include SURLYN® from E.I. DuPont de Nemours and Co. of Wilmington, Del. and IOTEK® from Exxon Corporation of Houston, Tex.

Surrounding the core with an ionomeric cover material provides a very durable golf ball. This core/cover combination permits golfers to impart a high initial velocity to the ball that results in improved distance.

Polyurethanes are used in a wide variety of applications including adhesives, sealants, coatings, fibers, injection molding components, thermoplastic parts, elastomers, and both rigid and flexible foams. Polyurethane is the product of a reaction between a polyurethane prepolymer and a curing agent. The polyurethane prepolymer is generally formed by a reaction between a polyol and a diisocyanate. The curing agents are typically diamines or glycols. A catalyst is often employed to promote the reaction between the curing agent and the polyurethane prepolymer.

Since about 1960, various companies have investigated the usefulness of polyurethane as a golf ball cover material. U.S. Pat. No. 4,123,061 teaches a golf ball made from a polyurethane prepolymer of polyether and a curing agent, such as a trifunctional polyol, a tetrafunctional polyol, or a fast-reacting diamine. U.S. Pat. No. 5,334,673 discloses the use of two categories of polyurethane available on the market, i.e., thermoset and thermoplastic polyurethanes, for forming golf ball covers and, in particular, thermoset polyurethane covered golf balls made from a composition of polyurethane prepolymer and a slow-reacting amine curing agent, and/or a difunctional glycol.

Polyurea covers are formed from a polyurea prepolymer, which typically includes at least one diisocyanate and at least one polyether amine, and a curing agent, which can be hydroxy-terminated curing agents, amine-terminated curing agents and combinations thereof.

Additionally, U.S. Pat. No. 3,989,568 discloses a three-component system employing either one or two polyurethane prepolymers and one or two polyol or fast-reacting diamine curing agents. The reactants chosen for the system must have different rates of reactions within two or more competing reactions.

The color instability caused by both thermo-oxidative degradation and photodegradation typically results in a "yellowing" or "browning" of the polyurethane layer, an undesirable characteristic for urethane compositions are to be used in the covers of golf balls, which are generally white.

U.S. Pat. No. 5,692,974 to Wu et al. discloses golf balls which have covers and cores and which incorporate urethane ionomers. The polyurethane golf ball cover has improved resiliency and initial velocity through the addition of an alkylating agent such as t-butyl chloride to induce ionic interactions in the polyurethane and thereby produce cationic type ionomers. UV stabilizers, antioxidants, and light stabilizers may be added to the cover composition.

U.S. Pat. No. 5,484,870 to Wu discloses a golf ball cover comprised of a polyurea. Polyureas are formed from reacting a diisocyanate with an amine.

U.S. Pat. No. 5,823,890 to Maruko et al., discloses a golf ball formed of a cover of an inner and outer cover layer compression molded over a core. The inner and outer cover layers should have a color difference $\Delta E$ in Lab color space of up to 3.

U.S. Pat. No. 5,840,788 to Lutz et al. discloses a UV light resistant, visibly transparent, urethane golf ball topcoat composition for use with UV curable inks. The topcoat includes an optical brightener that absorbs at least some UV light at wavelengths greater than about 350 nm, and emits visible light, and a stabilizer package. The light stabilizer package includes at least one UV light absorber and, optionally, at least one light stabilizer, such as a HALS.

U.S. Pat. No. 5,494,291 to Kennedy discloses a golf ball having a fluorescent cover and a UV light blocking, visibly transparent topcoat. The cover contains a fluorescent material that absorbs at least some UV light at wavelengths greater than 320 nm and emits visible light.

Colored golf balls have been produced for many years. In the 1960s Spalding produced a yellow range ball with a blended cover that included polyurethane.

U.S. Pat. No. 4,798,386, to Berard, makes reference to white cores and clear covers and even locating decoration on the core to be visible through the clear cover. The Berard concept requires a core which has a satisfactory hue to achieve the desired finished ball coloration. A polybutadiene rubber core of such a color has never been produced and as such, clear cover 2-pc ball have had limited market success.

U.S. Pat. No. 4,998,734 to Meyer, describes a golf ball with a core, a clear cover and "layer interdisposed therebetween." However, the intermediate layer described is a thin layer of paper or plastic material whose purpose is only to bear textural, alphanumeric or graphical indicia. Meyer teaches that the layer should be sufficiently thin to permit substantial transference of impact forces from the cover to the core without substantially reducing the force.

The Pro Keds "Crystal π" golf ball appeared in the Japanese market. It had a white core bearing the ball markings and a clear Surlyn cover. This ball had a very thick clear cover (>0.065") and the surface dimple coverage was very low.

In the early 1990s, Acushnet made clear Surlyn cover, two-piece Pinnacle Practice balls. The covers were 0.050" thick.

A prototype Wilson Surlyn covered two-piece ball, "Quantum", of a design similar to the Pro Keds ball was found in the US in the late 1990s. The cover was greater than 0.065 inches thick.

U.S. Pat. No. 5,442,680, Proudfit is directed to a golf ball with a clear ionomer cover. The patent requires a blend of ionomers with different cations.

In the early 1990s a solid one-piece urethane golf ball having a hole for the insertion of a chemi-luminescent tube was sold as a "Night Golf" ball. It was relatively translucent to create the glow, but it was far from having the performance characteristics of standard golf balls.

Two-piece balls have been sold under the tradename "Glow Owl" which utilize a white core and a cover with glow in the dark materials. This ball is believed to embody the technology described in U.S. Pat. No. 5,989,135 to Welch, which describes a "partially translucent" cover.

At the January 2001 PGA Show, Wilson displayed samples of "iWound" golf balls with clear covers. They were not balls for actual play but mock-ups used to display their new "lattice wound" technology. The lattice (discontinuous inner cover layer) was Hytrel and the Surlyn outer cover layer was clear. Both the Hytrel lattice and red core were visible through the clear cover. No markings were on the core or lattice.

U.S. Pat. No. 5,713,801 to Aoyama discloses a golf ball comprising an opaque cover, a core and a thin layer of elastic windings surrounding the core that forms a hoop-stress layer.

Commonly-owned U.S. Pat. No. 6,899,642, which is incorporated herein by reference in its entirety, discloses a golf ball comprising at least a core and an opaque cover, said cover comprising a matrix material and fibrous elements that act as a hoop-stress layer.

To date, it has been difficult to properly attain the desired long-term appearance of golf ball covers without adversely affecting golf ball performance. Many golf balls have at least one layer of "paint" covering the cover material, however paint has been shown to chip or otherwise become damaged during routine play. Hence, there is a need in the art for golf balls having a unique appearance and optimal performance characteristics.

SUMMARY OF THE INVENTION

The present invention is directed to golf balls having a core and at least one composite layer comprising visible fibrous elements, which may be randomly dispersed therein or ordered in an array. The fibrous elements may result in better golf ball properties including, but not limited to, improved resiliency, decreased moisture vapor transmission rate, and improved adhesion between adjacent ball layers. The composite layer is preferably translucent, so that the fibrous elements are visible to the golfers.

According to one embodiment of the present invention, a golf ball comprises at least a core and a composite layer surrounding the core, wherein said composite layer comprises fibers or flakes with high aspect ratios and a matrix material. The matrix material preferably comprises substantially transparent or translucent thermoplastic or thermoset polymers, such as polyurethane, polyurea, and ionomer resins, which allow the consumer to view the filament material embedded within.

The fibrous material may comprise polymers, glass, or metals, including shape memory alloys (SMAs) and ferromagnetic materials. In one embodiment of invention, a golf ball comprising a composite layer including a polymeric matrix material and ferromagnetic filament materials is subjected to induction heating (IH) to increase adhesion between the composite layer and other layers and/or the core.

The core of the golf ball of the present invention may be a solid single-piece core or a dual-core. A solid single-piece core preferably comprises a resilient polymer. A dual-core may further comprise a solid or wound layer and a fluid-filled center.

The golf ball of the present invention may further comprise an outer cover layer surrounding the composite layer. The outer cover layer preferably comprises a substantially transparent or translucent polymer. The golf ball may also include an intermediate layer disposed between the composite cover layer and the core. The intermediate layer may comprise a polymeric material or may comprise elastic fibers wound around the core to form a hoop-stress layer.

In one preferred embodiment, the golf ball comprises a core, a composite inner cover, an intermediate layer disposed between the core and composite layer, and an outer cover layer surrounding the composite inner cover layer. The composite and outer cover layer comprise a translucent polymer, and fiber flock is embedded in the translucent polymer of the composite cover layer so the fiber is visible from the exterior of the ball. Preferably, the fiber flock comprises fiber segments having lengths less than one inch. In one embodiment, all of the fiber segments have substantially equal dimensions. In other embodiment, the fiber segments are of unequal dimensions.

BRIEF DESCRIPTION OF THE DRAWINGS

The novel features that are characteristic of the present invention are set forth in the appended claims. However, the preferred embodiments of the invention, together with further objects and attendant advantages, are best understood by reference to the following detailed description in connection with the accompanying drawings in which:

DETAILED DESCRIPTION OF THE INVENTION

Figure 1A:
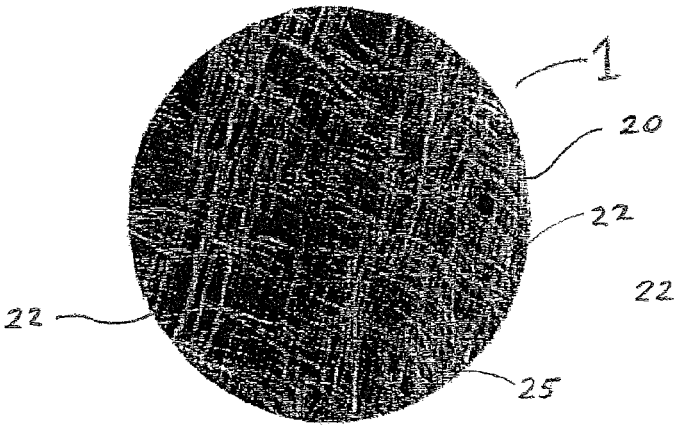
FIG. 1*a* is a plan view of a golf ball having a cover comprising a translucent polymeric matrix and a plurality of fibers embedded therewithin.

This invention is primarily directed to golf balls having a core and at least one layer comprising visible fibrous elements, which include high aspect ratio fibers or filament that may be randomly dispersed therein or ordered in a substantially transparent or translucent binder or matrix. The fibrous elements may also contain high aspect ratio flakes to create a unique visual effect. The visible fibrous elements and flakes may be present within, or beneath, a transparent or translucent cover layer. Visible fibrous elements and flakes may be disposed within, beneath or above any subsurface layer, e.g., a vapor transmission resistance layer, a high modulus layer, a hoop stress layer, an intermediate layer or an outer core layer. The cover may comprise a polymeric matrix material molded around fibrous elements, filaments or flakes. The core layer may be a single-piece or dual-core. A dual-core may comprise solid or wound layers, and may have an inner core comprising a fluid, i.e., a gas or liquid.

The incorporation of a transparent or translucent material into the construction of the golf ball enables direct consumer observation of technological features embedded within, or present beneath, the transparent or translucent layer. Additionally, the fibrous elements or particulate materials present within or beneath the translucent or transparent cover layer, or above the opaque surface of the core or intermediate layer but below the translucent or transparent cover layer provide the aesthetic features of the golf ball. The visible fibrous elements may result in better golf ball properties including, but not limited to, improved resiliency, decreased moisture vapor transmission rate, and improved adhesion between adjacent ball layers.

FIGS. 1*a-g* show golf balls (1-7) according to various embodiments of the present invention. The golf balls (1-7) pictured in FIGS. 1*a-g* comprise a translucent cover layer (20) and a fibrous material (22) either fully or partially embedded within the polymeric matrix of the translucent cover (20). The fibrous material (22) may be in various forms including, for example, individual, randomly dispersed fibers, mats of woven, non-woven, stitch-bonded non-woven or knitted fibers, ordered metal fibers, wound filaments, or fiber flock. The translucent cover (20) allows golfers to visualize the fibrous elements (22) included in the golf ball and a number of other internal elements, such as the surfaces of intermediate or core layers (25) within the ball. The visible fibers (22) and internal structure provide for a distinct and pleasing aesthetic effect.

A "translucent" matrix material preferably has an average transmittance of visible light (e.g., between about 380 nm and about 770 nm or alternately between about 400 nm and about 700 nm) of at least about 10 percent, preferably at least about 20 percent, more preferably at least about 30 percent. The average transmittance referred to herein is typically measured for incident light normal (i.e., at approximately 90°) to the plane of the object and can be measured using any known light transmission apparatus and method, e.g., a UV-Vis spectrophotometer.

A "transparent" matrix material preferably has an average transmittance of visible light (e.g., between about 380 nm and about 770 nm or alternately between about 400 nm and about 700 nm) of at least about 40 percent, preferably at least about 60 percent, more preferably at least about 80 percent. As used herein, the term, "translucent" materials or layers is meant to encompass "translucent" materials or layers. The term, "substantially transparent" materials or layers also may be used to refer to "translucent" materials or layers.

Suitable materials for fibrous elements, i.e., fibers or filament, present within, or beneath, a transparent or translucent cover layer are discussed in commonly-owned U.S. Pat. No. 6,899,642, which is incorporated herein by reference in its entirety. The fibrous elements may comprise polymers including but not limited to polyether urea such as LYCRA®, poly(ester-urea), polyester block copolymers such as HYTREL®, poly(propylene), polyethylene, polyamide, acrylics, polyketone, poly(ethylene terephthalate) such as DACRON®, poly(phenylene terephthalate) such as KEVLAR®, poly(acrylonitrile) such as ORLON®, trans-diaminodicyclohexylmethane, dodecanedicarboxylic acid such as QUINA® and poly(trimethylene terephthalate) as disclosed in U.S. Pat. No. 6,232,400 to Harris et al. SURLYN®. LYCRA®, HYTREL®, DACRON®, KEVLAR®, ARAMID®, ORLON®, and QUINA® are available from E. I. DuPont de Nemours & Co. SPECTRA® from the Honeywell Co. can also be used.

Fibrous materials also may comprise glass, such as S-GLASS® from Corning Corporation. Fibrous materials may also comprise metal. Suitable metal fibers include shape memory alloys (SMA). Examples of SMA materials that can be used are Ag—Cd, Cu—Al—Ni, Cu—Sn, Cu—Zn, Cu—Z—X (X=Si, Sn, Al), In—Ti, Ni—Al, Ni—Ti, Fe—Pt, Mn—Cu, and Fe—Mn—Si, however the present invention is not limited to these particular SMA materials. The filament material can include at least some fibers formed of a SMA, can include fibers that are all SMA, can include fibers that include some or all non-shape memory alloy materials, or the filament material can include a blend of SMA fibers and non-SMA fibers. For example, the filament material can include a Ni—Ti SMA fiber along with non-SMA fiber, such as carbon/epoxy fiber, to provide enhanced tensile strength in comparison to composites with only non-SMA fiber.

Preferably, the tensile modulus of the fibrous material is greater than the tensile modulus of the binder or matrix material comprising the cover. More preferably, the fibrous material has a tensile modulus or Young's modulus greater than about 30,000 psi. As used herein, tensile modulus of the fibrous material is defined in accordance with the ASTM D-3379-75 for single fiber filament material. ASTM D-4018-81 may be used to measure the tensile modulus for multi-fiber tows. ASTM D-638-01 may be used to measure the tensile modulus or Young's modulus of the matrix material. In a golf ball comprising a composite cover, wherein the cover comprises a matrix material and the fibrous material discussed above, this preferred range of tensile modulus of the fibrous material allows the cover to function as a hoop-stress element. For instance, in a golf ball comprising a cover and a core, the composite cover prevents the core from becoming excessively deformed after being hit, and rapidly returns the core to its spherical shape. The fibrous material is selected such that it can sustain sufficient deformation at impact and remains elastic, i.e. essentially deforming with as little energy loss as possible. As a result, the composite cover layer contributes significantly to the resiliency of the ball.

Fibers embedded within or beneath a transparent or translucent layer are discrete pieces of fibrous material. To allow direct observation by the golfer, the fibers should have a length of at least about 0.5 mm (500 μm) (0.02 inches). However the length of the fibers and fibrous elements of the present invention may vary as required to achieve a particular physical property, i.e., stiffness, or technological effect, i.e., moisture barrier, or simply to attain a desired aesthetic effect. In accordance with this aspect of the invention, individual fibers preferably have a length between about 0.5 mm (500 μm or 0.02 inches) and 10.0 mm (10000 μm or 0.40 inches). Fibers may be randomly dispersed beneath or within a translucent or transparent layer. FIG. 1*a* shows a golf ball according to this embodiment. Golf ball (1) comprises a translucent cover and plurality of fibers embedded therein. The fibers are randomly distributed throughout the cover and are easily viewed by a golfer due to the translucent nature of the polymeric matrix material comprising the cover.

Figure 1B:
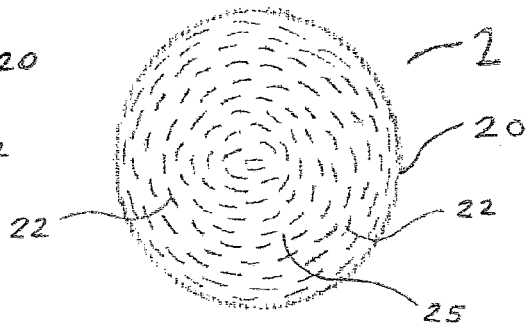
FIG. 1*b* is a plan view of a golf ball having a cover comprising a translucent polymeric matrix and a plurality of ordered fibers embedded therewithin.

Alternatively, fibers may be ordered in any array, as shown in FIG. 1*b*. In accordance with this aspect of the invention, golf ball (2) includes magnetized metal fibers or ferromagnetic fibers dispersed through an uncured or unset polymeric matrix material, injected around a core, and subjected to a magnetic field before curing or setting of the matrix material. Due to the magnetic field, the magnetized metal or ferromagnetic fibers can orient in a parallel or circular fashion.

Figure 1C:
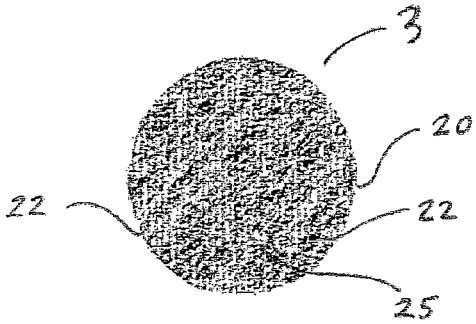
FIG. 1*c* is plan view of a golf ball having a cover comprising a translucent polymeric matrix and a mat of woven fibers at least partially embedded therewithin.
Figure 1D:
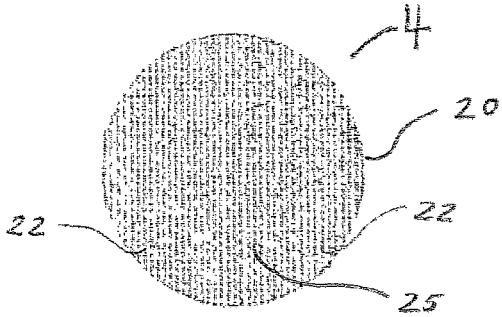
FIG. 1*d* is a plan view of a golf ball having a cover comprising a translucent polymeric matrix and a mat of non-woven stitch-bonded fibers at least partially embedded therewithin.
Figure 1E:
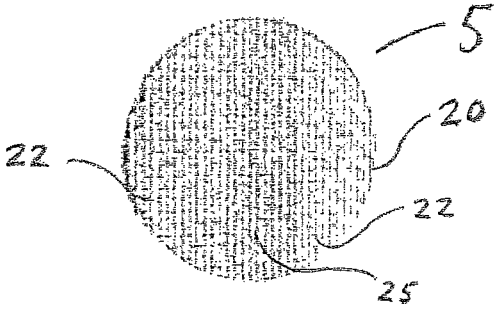
FIG. 1*e* is a plan view of a golf ball having a cover comprising a translucent polymeric matrix and a mat of woven fibers at least partially embedded therewithin.
Figure 1F:
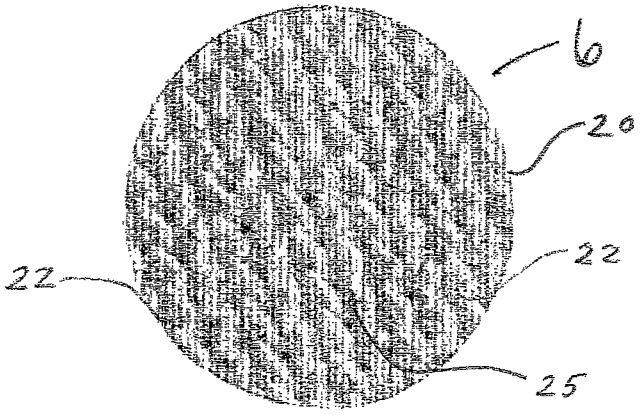
FIG. 1*f* is a plan view of a golf ball having a cover comprising a translucent polymeric matrix and a mat of knit fibers at least partially embedded therewithin.

A plurality of fibers may also form a mat, which may be woven, knit or non-woven. A single mat may be disposed around a core or intermediate layer. Non-woven mats can produce a visually pleasing effect as shown in FIG. 1*c*. Golf ball (3) comprises a translucent cover and a mat of non-woven fiber at least partially embedded in said cover. Non-woven mats can also be stitch-bonded for additional visual effects, as shown in golf ball (4) of FIG. 1*d*. As shown in FIG. 1*c*, the non-woven may be fully or partially embedded in the matrix material comprising the cover. FIG. 1*e* shows golf ball (5) having a translucent cover and a woven mat at least partially embedded therein. Golf ball (6) of FIG. 1*f* also comprises a translucent cover containing a woven mat; however, in this instance, the mat is knit-woven. The knit fiber mat may be fully or partially embedded in the translucent cover.

In one embodiment two mats, each cut into the shape of a figure-eight, are joined together in the fashion of a tennis ball to form a layer. Alternatively, one figure-eight fiber mat and one translucent or opaque figure-eight may be joined.

Figure 2A:
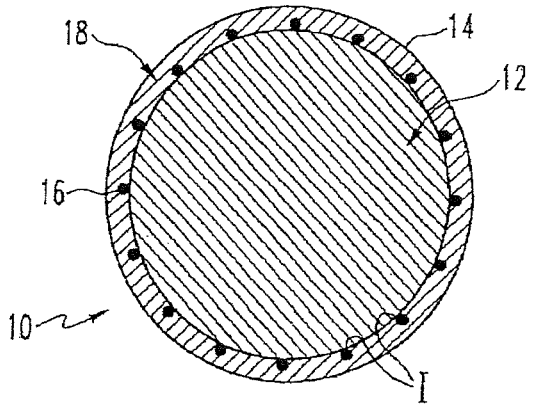
FIG. 2*a* is a cross-sectional view a golf ball having a core and a cover comprising a translucent matrix and a fibrous material.

A cross-sectional view of a golf ball according to this aspect of the invention is also shown in FIG. 2*a*. Golf ball (10) includes a core (12) surrounded by at least one transparent or translucent cover layer (14) formed of a composite material. The composite material forming the cover layer (14) includes fibers (16) embedded in a matrix material (18) as shown. In accordance with this embodiment, and as shown in FIG. 2*a*, fibers (16) contact the surface of core (12) at interface (I). As fibers (16) are at least partially embedded in matrix material (18), interface (I) is discontinuous. Fibers (16) may comprise polymers, glass, metal, or other materials discussed above as suitable fibrous material. As discussed above, the fibrous material (16) may be in various forms including, for example, individual, randomly dispersed fibers, mats of woven, non-woven, stitch-bonded non-woven or knitted fibers, ordered metal fibers, wound filaments, or fiber flock. Preferably, each fiber (16) has an aspect ratio, defined by average fiber length over average fiber diameter, of about 5 or greater. In other instances, the fibers (16) have an aspect ratio of less than about 5. Fibers (16) can also be embedded on the surface of core (12). For certain applications, e.g., the array of fibers shown in FIG. 2*a*, the spacings between fibers (16) are even. For non-woven mats, the spacings would be irregular. For woven or knit mats, interface (I) would be a connected layer.

Figure 2B:
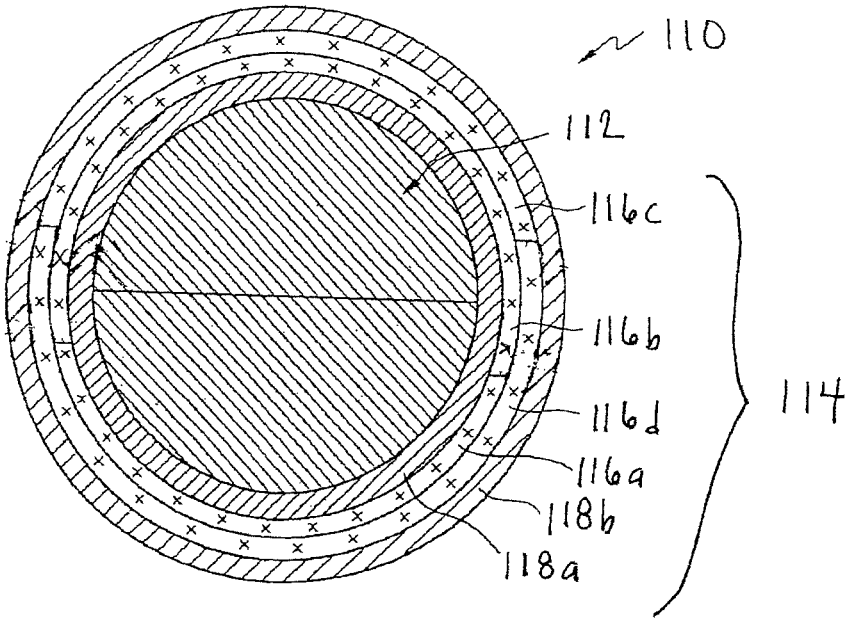
FIG. 2*b* is a cross-sectional view of a golf ball having a core and a cover comprising a translucent matrix and a plurality of fiber mats.

FIG. 2*b* shows a cross-sectional view of a golf ball including mats of woven or non-woven fibers. Golf ball (110) comprises core (112), fibers (116*a-d*) and matrix material (118*a* and 118*b*). Fibers (116*a-d*) form mats that may be woven or non-woven. In the case of woven mats, fibers (116*a-d*) may be connected such that the fibers of each mat are interconnected by the weaving process. In the case of non-woven mats, fibers (116*a-d*) may be connected such that bonding between the fibers of each mat interconnect the fibers of each mat. The fibers of one mat may be oriented in a first direction and fibers of the adjacent mat may be oriented in a second direction different from the first direction. The number and orientation of the mats can be varied with consideration to the properties and composition of the filament material and matrix material, and importantly to achieve desired ball properties. Matrix material (118*a* and *b*) may be molded around fibers (116*a-d*) so that the mats are embedded within the matrix material to form a single composite cover layer (114).

Figure 1G:
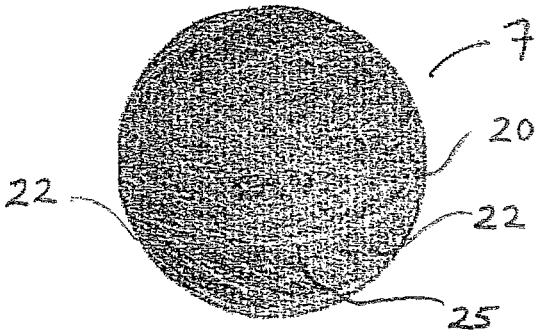
FIG. 1*g* is a plan view of a golf ball having a cover comprising a translucent polymeric matrix and a wound filament at least partially embedded therewithin.
Figure 2C:
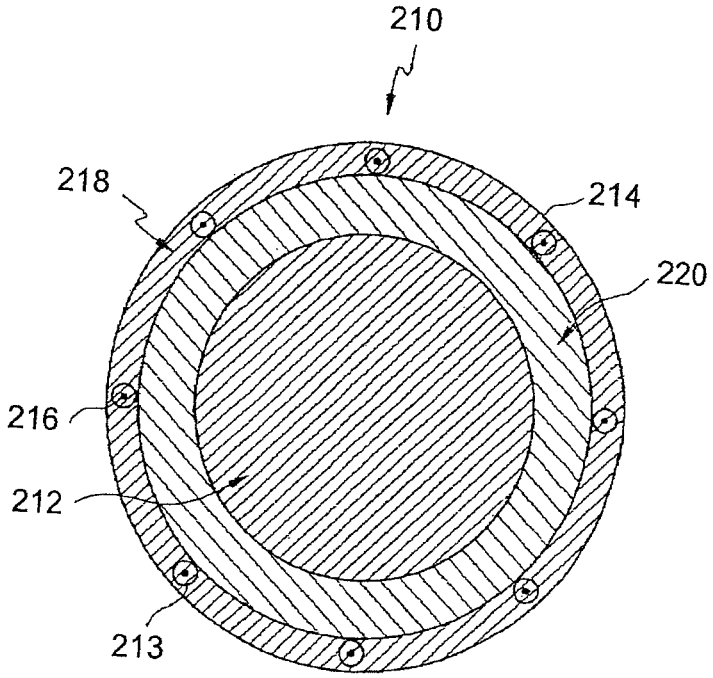
FIG. 2*c* is a cross-sectional view of a golf ball having a core, a cover comprising a translucent matrix and a fibrous material and an intermediate layer disposed between the core and the cover.

The fibrous material of the present invention may alternatively be a filament comprising a long length of fibrous material wound around a layer of the golf ball and either partially or fully embedded within a matrix material. The fibrous material may comprise a plurality of filaments, forming a multi-fiber bundle, wound around a layer of the golf ball. FIG. 1*g* shows golf ball (7), which includes a translucent cover and a layer of wound filament at least partially embedded in said cover. This embodiment of the present invention is also illustrated shown in FIG. 2*c*. Golf ball (210) comprises core (212), intermediate layer (220), and cover layer (214), comprising filament material (216) and matrix material (218). According to this embodiment, filament material (216) is preferably pre-coated with a matrix material prior to being wound around intermediate layer (220). Filament material (216) may comprise any of the fibrous materials discussed above and is preferably pre-coated with a translucent matrix material. The pre-winding matrix material (218), which is shown inside circle (213), need not be identical to the post-winding matrix material (218) that comprises the remaining portion of cover layer (214). Post-winding matrix material (218) may also comprise any of the translucent matrix materials previously discussed. As filament material (216) is substantially enveloped in pre-winding matrix material (218) and is embedded in post-winding matrix material (218), filament material (216) does not contact intermediate layer (220), and hence no interface exists. Filament material (216) preferably comprises many individual fibers or strands, and may be formed by such processes as melt spinning, wet spinning, dry spinning, or polymerization spinning.

Intermediate layer (220) may comprise materials such as polybutadiene, natural rubber, polyisoprene, styrene-butadiene, or ethylene-propylene-diene rubber or highly neutralized polymers. Intermediate layer (220) may alternatively comprise a matrix material. In another embodiment of the present invention, intermediate layer (220) comprises a layer of wound elastic fibers, forming a hoop-stress layer.

In accordance with this invention, wound filament material may be embedded within an intermediate layer, as opposed to a cover layer. In this case, the intermediate layer preferably comprises a translucent matrix material, further discussed below.

In accordance with another embodiment of the present invention, a golf ball may comprise at least a core and a cover layer and fibrous material comprising a metal or metals susceptible to induction heating (IH). Commonly-owned U.S. Patent Application Publication No. 2006/0148590 teaches a golf ball comprising metal materials heated through induction heating and is incorporated herein by reference in its entirety. Induction heating of the metal filament material can improve adhesion between layers comprising the metal filament material and adjacent layers. The process of IH includes applying an alternating current (AC) to an induction coil to generate a magnetic field, and supplying a work piece around which the magnetic field works. The work piece in this instance is the golf ball comprising fibrous material comprising metals sensitive to the magnetic field. Metal filament materials sensitive to magnetic fields resist the rapidly changing magnetic fields produced by AC within the induction coil, resulting in friction which produces heat known as hysteresis heating.

Figure 2D:
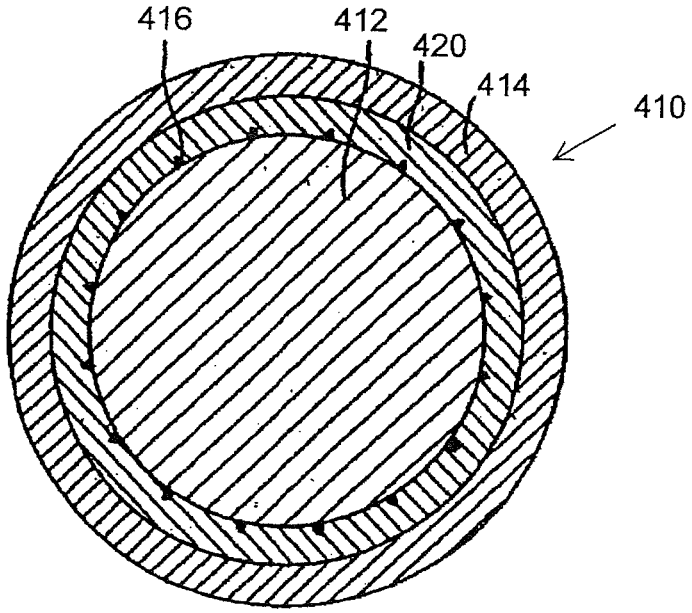
FIG. 2*d* is a cross-sectional view of a golf ball having a core, a cover layer and an intermediate layer comprising a polymeric material and a ferromagnetic fibrous material.

FIG. 1*b* provides a plan view of a golf ball according this aspect of the invention. Golf ball (2) has a translucent cover comprising a polymeric matrix material a plurality of ferromagnetic fibers at least partially embedded therein. FIG. 2*d* shows a cross-sectional view of another embodiment of a golf ball (410) in accordance with this invention. Golf ball (410) comprises core (412) and cover layer (414) and intermediate layer (420). Intermediate layer (420) further comprises metal filament material (416). Preferably, metal filament material (416) comprises ferromagnetic materials (FMMs) such as iron, nickel or cobalt, as they exhibit a strong attraction to magnetic fields and hence are easy to heat via IH. Intermediate layer (420) may comprise a translucent thermoset material such as polyurethane or polyurea. Cover layer (414) preferably comprises a translucent matrix material. Ferromagnetic filament material (416) is preferably at least partially embedded within intermediate layer (420). Induction heating of ferromagnetic filament material (416) can help to cure the thermoset material and improve adhesion between thermoset intermediate layer (420) and core (412) and cover layer (414).

In an alternative embodiment, cover layer (414) can comprise a thermoset material while intermediate layer (420) may comprise a composite layer including ferromagnetic filament material (416). Induction heating of ferromagnetic filament material (416) provides heat to indirectly cure thermoset cover layer (414), again improving adhesion between cover layer (414) and intermediate layer (420). Ferromagnetic filament material (416) may alternatively be embedded in cover layer (414).

Ferromagnetic filament material (416) is preferably a continuous filament wound or wrapped around core (412) and at least partially embedded in polymeric matrix material comprising intermediate layer (420). Examples of suitable FMMs include, but are not limited to, $Co_2Ba_2Fe_{12}O_{22}$, $Fe_3O_4$ (44 micron), $Fe_3O_4$ (840 micron), $Fe_2O_3$, $SrFe_{12}O_{19}$, iron, cobalt, nickel, the rare earth elements including lanthanum, cerium, praseodymium, neodymium, promethium, samarium, europium, gadolinium, terbium, dysprosium, holmium, erbium, thulium, ytterbium, and lutetium, the actinide elements including actinium, thorium, protactinium, uranium, neptunium, plutonium, americium, curium, berkelium, californium, einsteinium, fermium, mendelevium, nobelium, lawrencium, iron containing compounds such as iron based steel stocks, e.g. S45C and S55C, and pre-hardened steel stocks, e.g. NAK steel.

In another aspect of the invention, intermediate layer (420) acts as a moisture barrier layer. Ferromagnetic filament material (416) undergoes IH to improve adhesion between layers (420), (414), and (412). Intermediate layer (420) is preferably applied as a spray, dip or spin in a very thin coating applied over ferromagnetic filament material (416) in order to improve adhesion and prevent the penetration of moisture into golf ball (410).

According to another aspect of the invention, a golf ball may also comprise at least a cover, a core, and an intermediate layer comprising a metal mesh. The metal mesh may be formed around the core similar to the application of the cover of a tennis ball. Two metal mesh elements in the shape of a "figure eight" may be joined to form the intermediate layer. The cover of the golf ball is preferably a matrix material and may be molded around the intermediate metal mesh layer so that the metal mesh is at least partially embedded within the matrix material.

The core of the present invention may comprise a polymer such as ionomeric copolymers and terpolymers, thermoset materials, ionomer precursors, thermoplastics, thermoplastic elastomers, polybutadiene rubber, balata, grafted metallocene-catalyzed polymers, single-site polymers, high-crystalline acid polymers, cationic ionomers, and mixtures thereof. The core may be colored or may be transparent or translucent. As used herein, and as discussed in commonly-owned U.S. Patent Publication No. 2007/0149323, previously incorporated by reference, the term "core" refers to any portion of the golf ball surrounded by the cover. In the case of a golf ball comprising three layers, the core is the portion including at least the inner-most center layer and the intermediate layer, also referred to as the outer core layer, immediately surrounding the center. In accordance with the present invention, the intermediate or outer core layer may comprise a solid polymeric material or may be a layer of wound elastomeric material. An intermediate or outer core layer comprising a solid polymeric material may be colored or may be transparent or translucent.

A golf ball having a core comprising two layers may be referred to as a "dual-core" or a "multi-piece core." A golf ball of the present invention may also comprise a multi-piece core having more than two layers. The center of a dual-core or multi-piece core may comprise a solid material or a fluid, i.e., a gas or liquid. The center may alternatively comprise a semi-solid such as a paste or gel.

According to the desired performance parameters of the golf ball, the fluid-filled center of the core may comprise a gas, such as nitrogen, air, or argon; or a liquid, such as saline solution, corn syrup, saline solution and corn syrup, glycol in water, or oils. Other appropriate liquids for filling fluid-filled center include water soluble or dispersable organic compounds, pastes, colloidal suspensions, such as clay, barytes, carbon black in water or another liquid, or salt in water/glycol mixtures. The fluid-filled center may also comprise gels, such as water gelatin gels, hydrogels, water/methyl cellulose gels and gels comprised of copolymer rubber-based materials such as styrene-butadiene-styrene rubber and paraffinic and/or naphthionic oil. The fluid-filled center may also comprise melts, including waxes and hot melts (materials which are solid at or about room temperature but which become liquid at temperatures above room-temperature).

In one embodiment, the cores in the golf balls of this invention have high-reflectance properties. Particularly, the core layer(s) may comprise light-reflective fillers to effectively scatter light rays that strike the outer surface of the core. For example, these light-reflective fillers may be selected from the group consisting of pearlescent pigments, glitter specks, metalized films and foils, and mixtures thereof as discussed in further detail below. The light-reflective fillers preferably comprise particles preferably have faces that have an individual reflectance of over 75%, more preferably at least 95%, and most preferably 99-100%. For example, flat particles with two opposite faces can be used. The particle size preferably is 0.1 mm-1.0 mm more preferably 0.2 mm-0.8 mm, and most preferably 0.25 mm-0.5 mm In general, an aesthetically pleasing reflective appearance can be obtained by using about 0.1-10, or more preferably 1-4 parts by weight reflective particles based on the weight of base rubber or other polymer in the composition. In other instances, the core layer may be coated with a highly reflective coating using vacuum-depositing techniques, spray, dipping, or other suitable techniques. For example, a reflective layer of vacuum—deposited aluminum or chrome, indium and the like may be formed. Such a layer preferably has a thickness of between about 0.0001 and about 0.0010 inches. The core composition may comprise white pigments such as, for example, zinc oxide, barium sulfate, titanium dioxide, calcium oxide, or the like to provide the core composition with high reflectance. Preferably, titanium dioxide is used as the white pigment. The white pigments reflect the light rays to provide a bright white opaque core. In this preferred version, the core is substantially reflective and enhances the appearance of the surrounding composite layer that contains the decorative fiber as discussed further below.

In a second embodiment, the core composition may contain colored pigments such as blue, green, red, or yellow pigments or the like. These colored pigments absorb most of the incident light as opposed to the white pigments that reflect most of the light. Such a colored core can provide color vibrancy and depth to the golf ball. The colored core material provides a richly colored background for the substantially transparent surrounding composite layer that contains the decorative fiber as discussed further below.

The cover or intermediate layers of the present invention preferably comprise a binder or matrix material comprising a clear or translucent material and may be molded using any technique known in the art, such as injection molding, reaction injection molding, compression molding, or casting, depending on the material selected. Suitable matrix materials include, but are not limited to, thermoplastic, thermoset materials, polyurethane, polyurea, and ionomer resins. Examples of ionomer resins include SURLYN®, from E. I. DuPont de Nemours and Co. of Wilmington, Del. and IOTEK® from Exxon Corporation of Houston, Tex.

Polyurethane that is useful in the present invention includes the reaction product of polyisocyanate, at least one polyol, and at least one curing agent. Any polyisocyanate available to one of ordinary skill in the art is suitable for use according to the invention. Exemplary polyisocyanates include, but are not limited to, 4,4'-diphenylmethane diisocyanate ("MDI"), polymeric MDI, carbodiimide-modified liquid MDI, 4,4'-dicyclohexylmethane diisocyanate ("$H_{12}$MDI"), p-phenylene diisocyanate ("PPDI"), m-phenylene diisocyanate ("MPDI"), toluene diisocyanate ("TDI"), 3,3'-dimethyl-4,4'-biphenylene diisocyanate ("TODI"), isophoronediisocyanate ("IPDI"), hexamethylene diisocyanate ("HDI"), naphthalene diisocyanate ("NDI"); xylene diisocyanate ("XDI"); p-tetramethylxylene diisocyanate ("p-TMXDI"); m-tetramethylxylene diisocyanate ("m-TMXDI"); ethylene diisocyanate; propylene-1,2-diisocyanate; tetramethylene-1,4-diisocyanate; cyclohexyl diisocyanate; 1,6-hexamethylene-diisocyanate ("HDI"); dodecane-1,12-diisocyanate; cyclobutane-1,3-diisocyanate; cyclohexane-1,3-diisocyanate; cyclohexane-1,4-diisocyanate; 1-isocyanato-3,3,5-trimethyl-5-isocyanatomethylcyclohexane; methyl cyclohexylene diisocyanate; isocyanurate of HDI; triisocyanate of 2,4,4-trimethyl-1,6-hexane diisocyanate ("TMDI"), tetracene diisocyanate, napthalene diisocyanate, anthracene diisocyanate, and mixtures thereof. Polyisocyanates are known to those of ordinary skill in the art as having more than one isocyanate group, e.g., di-, tri-, and tetra-isocyanate. Preferably, the polyisocyanate includes MDI, PPDI, TDI, or a mixture thereof, and more preferably, the polyisocyanate includes MDI. It should be understood that, as used herein, the term "MDI" includes 4,4'-diphenylmethane diisocyanate, polymeric MDI, carbodiimide-modified liquid MDI, and mixtures thereof and, additionally, that the diisocyanate employed may be "low free monomer," understood by one of ordinary skill in the art to have lower levels of "free" isocyanate monomer, typically less than about 0.1 percent to about 0.5 percent free monomer. Examples of "low free monomer" diisocyanates include, but are not limited to Low Free Monomer MDI, Low Free Monomer TDI, Low Free MPDI, and Low Free Monomer PPDI.

The at least one polyisocyanate should have less than about 14 percent unreacted NCO groups. Preferably, the at least one polyisocyanate has less than about 7.9 percent NCO, more preferably, between about 2.5 percent and about 7.8 percent, and most preferably, between about 4 percent to about 6.5 percent.

Any polyol available to one of ordinary skill in the art is suitable for use according to the invention. Exemplary polyols include, but are not limited to, polyether polyols, hydroxy-terminated polybutadiene and partially/fully hydrogenated derivatives, polyester polyols, polycaprolactone polyols, and polycarbonate polyols. In one preferred embodiment, the polyol includes polyether polyol, more preferably those polyols that have the generic structure:

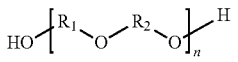

where $R_1$ and $R_2$ are straight or branched hydrocarbon chains, each containing from 1 to about 20 carbon atoms, and n ranges from 1 to about 45. Examples include, but are not limited to, polytetramethylene ether glycol, polyethylene propylene glycol, polyoxypropylene glycol, and mixtures thereof. The hydrocarbon chain can have saturated or unsaturated bonds and substituted or unsubstituted aromatic and cyclic groups. Preferably, the polyol of the present invention includes PTMEG.

In another embodiment, polyester polyols are included in the polyurethane material of the invention. Preferred polyester polyols have the generic structure:

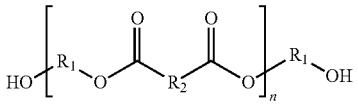

where $R_1$ and $R_2$ are straight or branched hydrocarbon chains, each containing from 1 to about 20 carbon atoms, and n ranges from 1 to about 25. Suitable polyester polyols include, but are not limited to, polyethylene adipate glycol, polybutylene adipate glycol, polyethylene propylene adipate glycol, ortho-phthalate-1,6-hexanediol, and mixtures thereof. The hydrocarbon chain can have saturated or unsaturated bonds, or substituted or unsubstituted aromatic and cyclic groups. In another embodiment, polycaprolactone polyols are included in the materials of the invention.

Preferably, any polycaprolactone polyols have the generic structure:

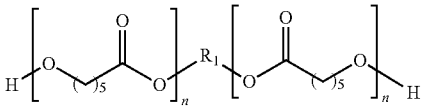

where $R_1$ is a straight chain or branched hydrocarbon chain containing from 1 to about 20 carbon atoms, and n is the chain length and ranges from 1 to about 20. Suitable polycaprolactone polyols include, but are not limited to, 1,6-hexanediol-initiated polycaprolactone, diethylene glycol initiated polycaprolactone, trimethylol propane initiated polycaprolactone, neopentyl glycol initiated polycaprolactone, 1,4-butanediol-initiated polycaprolactone, and mixtures thereof. The hydrocarbon chain can have saturated or unsaturated bonds, or substituted or unsubstituted aromatic and cyclic groups.

In yet another embodiment, the polycarbonate polyols are included in the polyurethane material of the invention. Preferably, any polycarbonate polyols have the generic structure:

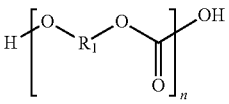

where $R_1$ is predominantly bisphenol A units -(p-$C_6H_4$)—C$(CH_3)_2$-(p-$C_6H_4$)— or derivatives thereof, and n is the chain length and ranges from 1 to about 20. Suitable polycarbonates include, but are not limited to, polyphthalate carbonate. The hydrocarbon chain can have saturated or unsaturated bonds, or substituted or unsubstituted aromatic and cyclic groups. In one embodiment, the molecular weight of the polyol is from about 200 to about 4000. Polyamine curatives are also suitable for use in the polyurethane composition of the invention and have been found to improve cut, shear, and impact resistance of the resultant balls. Preferred polyamine curatives have the general formula:

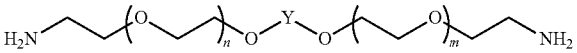

where n and m each separately have values of 0, 1, 2, or 3, and where Y is ortho-cyclohexyl, meta-cyclohexyl, para-cyclohexyl, ortho-phenylene, meta-phenylene, or para-phenylene, or a combination thereof. Preferred polyamine curatives include, but are not limited to, 3,5-dimethylthio-2,4-toluenediamine and isomers thereof (trade name ETHACURE 100 and/or ETHACURE 100 LC); 3,5-diethyltoluene-2,4-diamine and isomers thereof, such as 3,5-diethyltoluene-2,6-diamine; 4,4'-bis-(sec-butylamino)-diphenylmethane; 1,4-bis-(sec-butylamino)-benzene, 4,4'-methylene-bis-(2-chloroaniline); 4,4'-methylene-bis-(3-chloro-2,6-diethylaniline); trimethylene glycol-di-p-aminobenzoate; polytetramethyleneoxide-di-p-aminobenzoate; N,N'-dialkyl-diamino diphenyl methane; para,para'-methylene dianiline (MDA), m-phenylenediamine (MPDA), 4,4'-methylene-bis-(2-chloroaniline) (MOCA), 4,4'-methylene-bis-(2,6-diethylaniline), 4,4'-diamino-3,3'-diethyl-5,5'-dimethyl diphenylmethane, 2,2',3,3'-tetrachloro diamino diphenylmethane, 4,4'-methylene-bis-(3-chloro-2,6-diethylaniline), (LONZACURE M-CDEA), trimethylene glycol di-p-aminobenzoate (VERSALINK 740M), and mixtures thereof. Preferably, the curing agent of the present invention includes 3,5-dimethylthio-2,4-toluenediamine and isomers thereof, such as ETHACURE 300, commercially available from Albermarle Corporation of Baton Rouge, La. Suitable polyamine curatives, which include both primary and secondary amines, preferably have molecular weights ranging from about 64 to about 2000. Preferably, n and m, each separately, have values of 1, 2, or 3, and preferably, 1 or 2.

At least one of a diol, triol, tetraol, hydroxy-terminated, may be added to the aforementioned polyurethane composition. Suitable hydroxy-terminated curatives have the following general chemical structure:

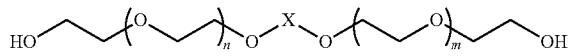

where n and m each separately have values of 0, 1, 2, or 3, and where X is ortho-phenylene, meta-phenylene, para-phenylene, ortho-cyclohexyl, meta-cyclohexyl, or para-cyclohexyl, or mixtures thereof. Preferably, n and m, each separately, have values of 1, 2, or 3, and more preferably, 1 or 2.

Preferred hydroxy-terminated curatives for use in the present invention include at least one of 1,3-bis(2-hydroxyethoxy)benzene and 1,3-bis-[2-(2-hydroxyethoxy) ethoxy] benzene, and 1,3-bis-{2-[2-(2-hydroxyethoxy) ethoxy] ethoxy}benzene; 1,4-butanediol; resorcinol-di-(β-hydroxyethyl)ether; and hydroquinone-di-(β-hydroxyethyl) ether; and mixtures thereof. Preferably, the hydroxy-terminated curatives have molecular weights ranging from about 48 to 2000. It should be understood that molecular weight, as used herein, is the absolute weight average molecular weight and would be understood as such by one of ordinary skill in the art. Both the hydroxy-terminated and amine curatives can include one or more saturated, unsaturated, aromatic, and cyclic groups. Additionally, the hydroxy-terminated and amine curatives can include one or more halogen groups. Suitable diol, triol, and tetraol groups include ethylene glycol, diethylene glycol, polyethylene glycol, propylene glycol, polypropylene glycol, lower molecular weight polytetramethylene ether glycol, and mixtures thereof. The polyurethane composition can be formed with a blend or mixture of curing agents. If desired, however, the polyurethane composition may be formed with a single curing agent.

The cover may alternatively comprise polyurea. In one embodiment, the polyurea prepolymer includes at least one diisocyanate and at least one polyether amine.

In this aspect of the invention the diisocyanate is preferably saturated, and can be selected from the group consisting of ethylene diisocyanate; propylene-1,2-diisocyanate; tetramethylene diisocyanate; tetramethylene-1,4-diisocyanate; 1,6-hexamethylene-diisocyanate; octamethylene diisocyanate; decamethylene diisocyanate; 2,2,4-trimethylhexamethylene diisocyanate; 2,4,4-trimethylhexamethylene diisocyanate; dodecane-1,12-diisocyanate; dicyclohexylmethane diisocyanate; cyclobutane-1,3-diisocyanate; cyclohexane-1,2-diisocyanate; cyclohexane-1,3-diisocyanate; cyclohexane-1,4-diisocyanate; methyl-cyclohexylene diisocyanate; 2,4-methylcyclohexane diisocyanate; 2,6-methylcyclohexane diisocyanate; 4,4'-dicyclohexyl diisocyanate; 2,4'-dicyclohexyl diisocyanate; 1,3,5-cyclohexane triisocyanate; isocyanatomethylcyclohexane isocyanate; 1-isocyanato-3,3,5-trimethyl-5-isocyanatomethylcyclohexane; isocyanatoethylcyclohexane isocyanate; bis(isocyanatomethyl)-cyclohexane diisocyanate; 4,4'-bis(isocyanatomethyl) dicyclohexane; 2,4'-bis(isocyanatomethyl)dicyclohexane; isophoronediisocyanate; triisocyanate of HDI; triisocyanate of 2,2,4-trimethyl-1,6-hexane diisocyanate; 4,4'-dicyclohexylmethane diisocyanate; 2,4-hexahydrotoluene diisocyanate; 2,6-hexahydrotoluene diisocyanate; and mixtures thereof. The saturated diisocyanate is preferably selected from the group consisting of isophoronediisocyanate, 4,4'-dicyclohexylmethane diisocyanate, 1,6-hexamethylene diisocyanate, or a combination thereof. In another embodiment, the diisocyanate is an aromatic aliphatic isocyanate selected from the group consisting of meta-tetramethylxylene diisocyanate; para-tetramethylxylene diisocyanate; trimerized isocyanurate of polyisocyanate; dimerized uredione of polyisocyanate; modified polyisocyanate; and mixtures thereof.

The polyether amine may be selected from the group consisting of polytetramethylene ether diamines, polyoxypropylene diamines, poly(ethylene oxide capped oxypropylene) ether diamines, triethyleneglycoldiamines, propylene oxide-based triamines, trimethylolpropane-based triamines, glycerin-based triamines, and mixtures thereof. In one embodiment, the polyether amine has a molecular weight of about 1000 to about 3000.

The curing agent may be selected from the group consisting of hydroxy-terminated curing agents, amine-terminated curing agents, and mixtures thereof, and preferably has a molecular weight from about 250 to about 4000.

In one embodiment, the hydroxy-terminated curing agents are selected from the group consisting of ethylene glycol; diethylene glycol; polyethylene glycol; propylene glycol; 2-methyl-1,3-propanediol; 2-methyl-1,4-butanediol; dipropylene glycol; polypropylene glycol; 1,2-butanediol; 1,3-butanediol; 1,4-butanediol; 2,3-butanediol; 2,3-dimethyl-2,3-butanediol; trimethylolpropane; cyclohexyldimethylol; triisopropanolamine; tetra-(2-hydroxypropyl)-ethylene diamine; diethylene glycol di-(aminopropyl)ether; 1,5-pentanediol; 1,6-hexanediol; 1,3-bis-(2-hydroxyethoxy)cyclohexane; 1,4-cyclohexyldimethylol; 1,3-bis-[2-(2-hydroxyethoxy) ethoxy]cyclohexane; 1,3-bis-{2-[2-(2-hydroxyethoxy) ethoxy]ethoxy}cyclohexane; trimethylolpropane; polytetramethylene ether glycol, preferably having a molecular weight from about 250 to about 3900; and mixtures thereof.

The amine-terminated curing agents may be selected from the group consisting of ethylene diamine; hexamethylene diamine; 1-methyl-2,6-cyclohexyl diamine; tetrahydroxypropylene ethylene diamine; 2,2,4- and 2,4,4-trimethyl-1,6-hexanediamine; 4,4'-bis-(sec-butylamino)-dicyclohexylmethane; 1,4-bis-(sec-butylamino)-cyclohexane; 1,2-bis-(sec-butylamino)-cyclohexane; derivatives of 4,4'-bis-(sec-butylamino)-dicyclohexylmethane; 4,4'-dicyclohexylmethane diamine; 1,4-cyclohexane-bis-(methylamine); 1,3-cyclohexane-bis-(methylamine); diethylene glycol di-(aminopropyl)ether; 2-methylpentamethylene-diamine; diaminocyclohexane; diethylene triamine; triethylene tetramine; tetraethylene pentamine; propylene diamine; 1,3-diaminopropane; dimethylamino propylamine; diethylamino propylamine; imido-bis-propylamine; monoethanolamine, diethanolamine; triethanolamine; monoisopropanolamine, diisopropanolamine; isophoronediamine; and mixtures thereof.

In one embodiment, the composition further includes a catalyst that can be selected from the group consisting of a bismuth catalyst, zinc octoate, di-butyltin dilaurate, di-butyltin diacetate, tin (II) chloride, tin (IV) chloride, di-butyltin dimethoxide, dimethyl-bis[1-oxonedecyl)oxy]stannane, di-n-octyltin bis-isooctyl mercaptoacetate, triethylenediamine, triethylamine, tributylamine, oleic acid, acetic acid; delayed catalysts, and mixtures thereof. The catalyst may be present from about 0.005 percent to about 1 percent by weight of the composition.

Any method available to one of ordinary skill in the art may be used to combine the polyisocyanate, polyol or polyamine, and curing agent of the present invention. One commonly employed method, known in the art as a one-shot method, involves concurrent mixing of the polyisocyanate, polyol or polyether amine, and curing agent. This method results in a mixture that is inhomogenous (more random) and affords the manufacturer less control over the molecular structure of the resultant composition. A preferred method of mixing is known as the prepolymer method. In this method, the polyisocyanate and the polyol or polyether amine are mixed separately prior to addition of the curing agent. This method seems to afford a more homogeneous mixture resulting in a more consistent polymer composition.

The matrix material may also comprise ionomeric materials, such as ionic copolymers of ethylene and an unsaturated monocarboxylic acid, which are available under the trademark SURLYN® of E.I. DuPont de Nemours & Co., of Wilmington, Del., or IOTEK® or ESCOR® of Exxon. These are copolymers or terpolymers of ethylene and methacrylic acid or acrylic acid totally or partially neutralized, i.e., from about 1 to about 100 percent, with salts of zinc, sodium, lithium, magnesium, potassium, calcium, manganese, nickel or the like. In one embodiment, the carboxylic acid groups are neutralized from about 10 percent to about 100 percent. The carboxylic acid groups may also include methacrylic, crotonic, maleic, fumaric or itaconic acid. The salts are the reaction product of an olefin having from 2 to 10 carbon atoms and an unsaturated monocarboxylic acid having 3 to 8 carbon atoms.

The ionomeric material may acid-containing ethylene copolymer ionomers, including E/X/Y terpolymers where E is ethylene, X is an acrylate or methacrylate-based softening comonomer present in about 0 to 50 weight percent and Y is acrylic or methacrylic acid present in about 5 to 35 weight percent. The ionomer may include so-called "low acid" and "high acid" ionomers, as well as blends thereof. In general, ionic copolymers including up to about 15 percent acid are considered "low acid" ionomers, while those including greater than about 15 percent acid are considered "high acid" ionomers.

"Low acid" ionomers may be combined with a softening comonomer such as vinyl esters of aliphatic carboxylic acids wherein the acids have 2 to 10 carbon atoms, vinyl ethers wherein the alkyl groups contains 1 to 10 carbon atoms, and alkyl acrylates or methacrylates wherein the alkyl group contains 1 to 10 carbon atoms. Suitable softening comonomers include vinyl acetate, methyl acrylate, methyl methacrylate, ethyl acrylate, ethyl methacrylate, butyl acrylate, and butyl methacrylate, and are believed to impart high spin to golf balls.

Covers comprising "high acid" ionomers are believe to impart low spin and longer distance to golf balls. A cover of the present invention may comprise about 15 to about 35 weight percent acrylic or methacrylic acid, making the ionomer a high modulus ionomer. An additional comonomer such as an acrylate ester (i.e., iso- or n-butylacrylate, etc.) can also be included to produce a softer terpolymer. The additional comonomer may be selected from the group consisting of vinyl esters of aliphatic carboxylic acids wherein the acids have 2 to 10 carbon atoms, vinyl ethers wherein the alkyl groups contains 1 to 10 carbon atoms, and alkyl acrylates or methacrylates wherein the alkyl group contains 1 to 10 carbon atoms. Suitable softening comonomers include vinyl acetate, methyl acrylate, methyl methacrylate, ethyl acrylate, ethyl methacrylate, butyl acrylate, butyl methacrylate, or the like.

The translucent binder or matrix material may additionally comprise pigment or dye in an amount sufficient to provide a hue to the material but maintain translucence. Suitable dyes include fluorescent dyes such as from the thioxanthene, xanthene, perylene, perylene imide, coumarin, thioindigoid, naphthalimide and methine dye classes. Useful dye classes have been more completely described in U.S. Pat. No. 5,674,622, which is incorporated herein by reference in its entirety. Representative yellow fluorescent dye examples include, but are not limited to: Lumogen F Orange™ 240 (BASF, Rensselaer, N.Y.); Lumogen F Yellow™ 083 (BASF, Rensselaer, N.Y.); Hostasol Yellow™ 3G (Hoechst-Celanese, Somerville, N.J.); Oraset Yellow™ 8GF (Ciba-Geigy, Hawthorne, N.Y.); Fluorol 088™ (BASF, Rensselaer, N.Y.); Thermoplast F Yellow™ 084 (BASF, Rensselaer, N.Y.); Golden Yellow™ D-304 (DayGlo, Cleveland, Ohio); Mohawk Yellow™ D-299 (DayGlo, Cleveland, Ohio); Potomac Yellow™ D-838 (DayGlo, Cleveland, Ohio) and Polyfast Brilliant Red™ SB (Keystone, Chicago, Ill.).

The binder or matrix materials described above may also comprise reflective, pearlescent or iridescent particulate materials. The cover may contain reflective or optically active particulates such as described by Murphy in U.S. Pat. No. 5,427,378 which is incorporated herein by reference. Pearlescent pigments sold by the Mearle Corporation can also be used in this way. The reflective particulates preferably have an aspect ratio of about 5 or greater and may comprise at least one member selected from the group consisting of metal flake, iridescent glitter, metalized film and colored polyester foil.

In another embodiment of the invention, the cover may be cast or compression molded. This process involves the joining of two cover hemispheres at an equator. As such, the cover may comprise one hemisphere comprising a substantially transparent or translucent cover comprising the materials discussed above and one conventional opaque or white hemisphere. Additionally, other inventive aspects of the present invention, such as a cover comprising fibers or filaments, woven or non-woven fibrous mats, ferromagnetic filaments, high aspect ratio reflective particulates or metal mesh may be incorporated into only one hemisphere of the golf ball cover.

The substantially transparent polymeric matrix is sufficiently free of light-reflective fillers, pigments, dyes, fluorescent materials, optical brighteners, glitter specks, metalized films and foils, and the like so that it can admit the necessary amount of light for making the fiber members more visible. In some instances, however, it may be desirable to include a relatively small amount of such additives in the polymeric matrix to enhance the decorative effect. For example, light reflective fillers including, but not limited to, pearlescent pigments, glitter specks, metalized films and foils, and mixtures thereof can be incorporated into the polymeric matrix; provided, the matrix remains clear enough to see the decorative fiber.

Pearlescent pigments are particularly preferred, because these materials can provide special luster effects. Pearlescent pigment is generally made up of multiple platelet-like semi-transparent particles. When light strikes the platelets, it is partially reflected and partially transmitted through them. There are many platelet surfaces in parallel orientation and many layers of pigment at different depths within the pearlescent pigment-containing paint, coating, or other composition. As light reflects off the platelet surfaces in the different layers, this creates a pearly luster effect. A person looking at the composition will see different reflections and scattering of light depending upon their viewing angle. Some pearlescent pigments do not have a layered structure, that is, they comprise discrete particles and do not contain coated substrates. For example, metal-effect pearlescent pigments such as aluminum, copper, copper-zinc (bronze) alloys, and zinc particles may be used. Basic lead carbonate and bismuth oxychloride pigment particles also can be used. Other pearlescent pigments have a layered structure, that is, they contain a substrate. For example, natural or synthetic mica platelets may be coated with iron oxide or titanium dioxide to form special effect pearlescent pigments. Organic pigments also can be crystallized to form pigment flakes and pigments having a natural pearlescence such as pigment suspensions derived from fish scales may be used.

Metalized films and foils, particularly metalized polyester films and aluminum foil, and glitter specks, which comprises very small plastic pieces painted in metallic, neon, and iridescent colors to reflect light also can be used as reflective fillers in accordance with this invention.

Titanium dioxide pigment is preferably used as light-reflective filler, because of its light scattering properties including reflectivity and refraction. As the light strikes the surface of the composition, most of the light will be reflected because of the titanium dioxide pigment concentration. The light strikes the surface of the pigment (which has a relatively high refractive index in contrast to the binder resin), the light is bent and reflected outwardly. The portion of light which is not reflected will pass through the particles and will be bent in different direction. Other useful metal (or metal alloy) flakes, plates, powders, or particles may include bismuth boron, brass, bronze, cobalt, copper, nickel, chrome, iron, molybdenum, nickel powder, stainless steel, zirconium aluminum, tungsten metal, beryllium metal, zinc, or tin. Other metal oxides may include zinc oxide, iron oxide, aluminum oxide, magnesium oxide, zirconium oxide, and tungsten trioxide also may be suitable.

In other instances, the substantially transparent polymeric matrix may be lightly colored or tinted so long as the fiber member remains visible. For example, a relatively small amount of colored pigments such as blue, green, red, or yellow pigments or the like may be blended in the polymeric matrix to impart some color to the composite layer, but it is important that the fiber member remains visible. Suitable pigments include nickel and chrome titanates, chrome yellow, cadmium types, carbon black, chrome oxide green types, phthalocyanine blue or green, perylene and quinacridone types, and other conventional pigments. Pigment extenders include, for example, barytes, heavy spar, microtalc, kaolin, micaceous iron oxide, magnesium mica, quartz flour, powdered slate, and silicon carbide.

Likewise, if a fluorescent effect is desired, a relatively small amount of fluorescent dye may be added to the polymeric matrix so long as the fiber member remains visible. Suitable fluorescent dyes include, for example, dyes from the thioxanthene, xanthene, perylene, perylene imide, coumarin, thioindigoid, naphthalimide and methine dye classes. Representative yellow fluorescent dye examples include, but are not limited to: Lumogen F Orange™ 240 (BASF, Rensselaer, N.Y.); Lumogen F Yellow™ 083 (BASF, Rensselaer, N.Y.); Hostasol Yellow™ 3G (Hoechst-Celanese, Somerville, N.J.); Oraset Yellow™ 8GF (Ciba-Geigy, Hawthorne, N.Y.); Fluorol 088™ (BASF, Rensselaer, N.Y.); Thermoplast F Yellow™ 084 (BASF, Rensselaer, N.Y.); Golden Yellow™ D-304 (DayGlo, Cleveland, Ohio); Mohawk Yellow™ D-299 (DayGlo, Cleveland, Ohio); Potomac Yellow™ D-838 (DayGlo, Cleveland, Ohio) and Polyfast Brilliant Red™ SB (Keystone, Chicago, Ill.) Conventional non-fluorescent dyes also may be used including, but not limited to, azo, heterocyclic azo, anthraquinone, benzodifuranone, polycyclic aromatic carbonyl, indigoid, polymethine, styryl, di- and tri-aryl carbonium, phthalocyanines, quinopphthalones, sulfur, nitro and nitroso, stilbene, and formazan dyes.

Optical brighteners, which typically emit a bluish light, also may be added to the composition. In general, optical brighteners absorb the invisible ultra-violet portion of the daylight spectrum and convert this energy into the longer-wavelength visible portion of the spectrum. Suitable optical brighteners include, for example, stilbene derivatives, styryl derivatives of benzene and biphenyl, bis(benzazol-2-yl) derivatives, coumarins, carbostyrils, naphthalimides, derivatives of dibenzothiophene-5,5-dioxide, pyrene derivatives, and pyridotriazoles. In accordance with the present invention, any of these or other known optical brighteners including derivatives of 4,4'-diamino stilbene-2,2'-disulfonic acid, 4-methyl-7-diethylamino coumarin and 2,5-bis(5-tert-butyl)-2-benzoxazolyl)thiophene.

The decorative fiber is embedded in the substantially transparent composite layer, and the composite layer is surrounded by an underlying core structure and an overlying cover structure. This construction provides the ball with unique aesthetics. Particularly, in one embodiment, the underlying core structure has an optically opaque appearance. More particularly, the composition used to form the core may have a high concentration of white pigment (for example, titanium dioxide) so that the core has high reflectance. The white pigments reflect the light rays to provide a bright, white, opaque core. The incident light rays (except for a small amount that are absorbed by the polymer and/or pigment) that strike the surface of the core are reflected outwardly so the core appears opaque and white. At least a portion of these reflected light rays enter the surrounding composite layer containing the decorative fiber. Some of the light entering the composite layer will strike the solid, embedded decorative fiber and bounce off in multiple directions to provide a striking appearance. In addition, light rays pass through the overlying cover material and enter the composite layer from different directions. As the light enters the composite layer from different directions and path lengths, it is scattered randomly to enhance the appearance of the composite layer and embedded decorative fiber.

In a second embodiment, the underlying core structure has an optically opaque appearance, because the composition used to form the core has a high concentration of colored pigment. The colored pigments provide opacity by absorbing the incident light at selective wavelengths. In general, the pigments only absorb certain light wavelengths of the visible spectrum (red, orange, yellow, green, and blue). The light frequencies, which are not absorbed, are transmitted back to give the appearance of a specific color. Thus, in colored cores, the incident light rays that strike the surface of the core are selectively absorbed so the core appears opaquely colored. Such a colored core can provide color vibrancy and depth to the substantially transparent surrounding composite layer. Thus, a person looking through the substantially transparent cover and composite layer can see the underlying fiber against a richly colored background. Different colored cores and decorative fiber members can be used to create different coloring effects. In another example, the substantially transparent cover layer can be lightly colored. The colored cover material, which lies above the composite layer, and the colored core, which lies beneath the composite layer, can provide the ball with color striking highlights. The substantially transparent composite layer and embedded fiber, which is disposed between the core and cover structures, may scatter the colored light in different directions to produce unique visuals. In addition, reflective fillers and other ingredients can be added to the core and cover structures to provide the ball with a glossy, semi-glossy, or matte-like finished appearance. Another advantage of the present invention is that the decorative fiber can be added to the composite layer to provide a unique ornamental affect without sacrificing the playing performance properties of the ball such as resiliency and spin control.

In one embodiment of this invention, chopped fiber (fiber flock) is used as the fibrous material and is embedded in the translucent composite layer and/or outer cover layer. The fiber flock is produced by cutting or grinding fiber tow into the desired length. Preferably, the fiber flock has a length in the range of about 0.1 mm (100 μm or 0.004 inches) to about 5.0 mm (5000 μm or 0.2 inches), preferably in the range of about 0.5 mm (500 μm or 0.02 inches) to about 2.0 mm (2000 μm or 0.08 inches). In one version, the fibers are precisely cut so that all of the cut fiber lengths are approximately equal. In another version, the fibers are not precisely cut, and the cut fiber lengths are of different lengths. In one embodiment, the fiber segments of the fiber flock have an aspect ratio (length to diameter) of greater than about 5. In other embodiments, the fiber segments of the fiber flock have an aspect ratio of less than about 5.

A wide variety of thermoplastic and thermoset materials may be used in forming the translucent composite layer and/or outer cover layer of this invention including, for example, polyurethanes; polyureas; copolymers, blends and hybrids of polyurethane and polyurea; olefin-based copolymer ionomer resins (for example, Surlyn® ionomer resins and DuPont HPF® 1000 and HPF® 2000, commercially available from DuPont; Iotek® ionomers, commercially available from ExxonMobil Chemical Company; Amplify® IO ionomers of ethylene acrylic acid copolymers, commercially available from Dow Chemical Company; and Clarix® ionomer resins, commercially available from A. Schulman Inc.); polyethylene, including, for example, low density polyethylene, linear low density polyethylene, and high density polyethylene; polypropylene; rubber-toughened olefin polymers; acid copolymers, for example, poly(meth)acrylic acid, which do not become part of an ionomeric copolymer; plastomers; flexomers; styrene/butadiene/styrene block copolymers; styrene/ethylene-butylene/styrene block copolymers; dynamically vulcanized elastomers; copolymers of ethylene and vinyl acetates; copolymers of ethylene and methyl acrylates; polyvinyl chloride resins; polyamides, poly(amide-ester) elastomers, and graft copolymers of ionomer and polyamide including, for example, Pebax® thermoplastic polyether block amides, commercially available from Arkema Inc; cross-linked trans-polyisoprene and blends thereof; polyester-based thermoplastic elastomers, such as Hytrel®, commercially available from DuPont or RiteFlex®, commercially available from Ticona Engineering Polymers; polyurethane-based thermoplastic elastomers, such as Elastollan®, commercially available from BASF; synthetic or natural vulcanized rubber; and combinations thereof. Castable polyurethanes, polyureas, and hybrids of polyurethanes-polyureas are particularly desirable because these materials can be used to make a golf ball having good playing performance properties. By the term, "hybrids of polyurethane and polyurea," it is meant to include copolymers and blends thereof.

As discussed above, a wide variety of thermoset rubber materials may be used to form the core layer including, but not limited to, polybutadiene, polyisoprene, ethylene propylene rubber ("EPR"), ethylene-propylene-diene ("EPDM") rubber, styrene-butadiene rubber, styrenic block copolymer rubbers (such as "SI", "SIS", "SB", "SBS", "SIBS", and the like, where "S" is styrene, "I" is isobutylene, and "B" is butadiene), polyalkenamers such as, for example, polyoctenamer, butyl rubber, halobutyl rubber, polystyrene elastomers, polyethylene elastomers, polyurethane elastomers, polyurea elastomers, metallocene-catalyzed elastomers and plastomers, copolymers of isobutylene and p-alkylstyrene, halogenated copolymers of isobutylene and p-alkylstyrene, copolymers of butadiene with acrylonitrile, polychloroprene, alkyl acrylate rubber, chlorinated isoprene rubber, acrylonitrile chlorinated isoprene rubber, and blends of two or more thereof. Preferably, the core layer is formed from a polybutadiene rubber.

In alternative embodiments, the core layer may comprise a thermoplastic material, for example, an ionomer composition containing acid groups that are at least partially-neutralized. Suitable ionomer compositions include partially-neutralized ionomers and highly-neutralized ionomers (HNPs), including ionomers formed from blends of two or more partially-neutralized ionomers, blends of two or more highly-neutralized ionomers, and blends of one or more partially-neutralized ionomers with one or more highly-neutralized ionomers. For purposes of the present disclosure, "HNP" refers to an acid copolymer after at least 70% of all acid groups present in the composition are neutralized. Preferred ionomers are salts of O/X- and O/X/Y-type acid copolymers, wherein O is an α-olefin, X is a $C_3$-$C_8$ α,β-ethylenically unsaturated carboxylic acid, and Y is a softening monomer. O is preferably selected from ethylene and propylene. X is preferably selected from methacrylic acid, acrylic acid, ethacrylic acid, crotonic acid, and itaconic acid. Methacrylic acid and acrylic acid are particularly preferred. Y is preferably selected from (meth)acrylate and alkyl (meth)acrylates wherein the alkyl groups have from 1 to 8 carbon atoms, including, but not limited to, n-butyl (meth)acrylate, isobutyl (meth)acrylate, methyl (meth)acrylate, and ethyl (meth)acrylate.

Preferred O/X and O/X/Y-type copolymers include, without limitation, ethylene acid copolymers, such as ethylene/(meth)acrylic acid, ethylene/(meth)acrylic acid/maleic anhydride, ethylene/(meth)acrylic acid/maleic acid mono-ester, ethylene/maleic acid, ethylene/maleic acid mono-ester, ethylene/(meth)acrylic acid/n-butyl (meth)acrylate, ethylene/(meth)acrylic acid/iso-butyl (meth)acrylate, ethylene/(meth) acrylic acid/methyl (meth)acrylate, ethylene/(meth)acrylic acid/ethyl (meth)acrylate terpolymers, and the like. The term, "copolymer," as used herein, includes polymers having two types of monomers, those having three types of monomers, and those having more than three types of monomers. Preferred α,β-ethylenically unsaturated mono- or dicarboxylic acids are (meth)acrylic acid, ethacrylic acid, maleic acid, crotonic acid, fumaric acid, itaconic acid. (Meth)acrylic acid is most preferred. As used herein, "(meth)acrylic acid" means methacrylic acid and/or acrylic acid. Likewise, "(meth)acrylate" means methacrylate and/or acrylate.

The O/X or O/X/Y-type copolymer is at least partially neutralized with a cation source, optionally in the presence of a high molecular weight organic acid, such as those disclosed in U.S. Pat. No. 6,756,436, the entire disclosure of which is hereby incorporated herein by reference. The acid copolymer can be reacted with the optional high molecular weight organic acid and the cation source simultaneously, or prior to the addition of the cation source. Suitable cation sources include, but are not limited to, metal ion sources, such as compounds of alkali metals, alkaline earth metals, transition metals, and rare earth elements; ammonium salts and monoamine salts; and combinations thereof. Preferred cation sources are compounds of magnesium, sodium, potassium, cesium, calcium, barium, manganese, copper, zinc, lead, tin, aluminum, nickel, chromium, lithium, and rare earth metals.

In another embodiment of this invention, a fiber-flocking method is used to incorporate fiber in the ball. In general, fiber-flocking involves coating an adhesive onto a substrate and applying finely chopped fibers onto the adhesive-coated substrate by means of dusting, air-blasting, electrostatic attraction, or the like. In the present invention, a spherical core as discussed above may be provided. The core may be treated with an adhesive and then fiber-flock may be applied to the adhesive-coated core. Then, the adhesive-coated core is dried so that the fiber flock is bonded to the surface of the core. A cover material is molded over the core using conventional techniques. The cover material comprises translucent polymer, so that in the finished golf ball, the flocked fiber is visible from the exterior of the ball.

The chopped fiber (flock), which is applied to the adhesive-coated substrate, is produced by cutting or grinding fiber tow into the desired length. Typically, the fiber flock has a length in the range of about 0.1 to about 0.5 mm, preferably in the range of about 0.5 to about 2.0 mm. In one version, the fibers are precisely cut so that all of the cut fiber lengths are approximately equal. The cut fiber lengths fall within a narrow range. These precision-cut fibers are particularly effective for providing a dense and plush pile finish. In a second version, the fibers are randomly cut so the fiber lengths are not uniform. The randomly cut fiber have lengths that fall within a broad range. These random-cut fibers are particularly effective at providing a decorative finish—the resulting pile is less dense.

Any suitable fiber type may be used to provide the fiber flock including, for example, polyether urea such as LYCRA®, poly(ester-urea), polyester block copolymers such as HYTREL®, poly(propylene), polyethylene, polyamide, acrylics, polyketone, poly(ethylene terephthalate) such as DACRON®, poly(phenylene terephthalate) such as KEVLAR®, poly(acrylonitrile) such as ORLON®, trans-diaminodicyclohexylmethane, dodecanedicarboxylic acid such as QUINA®. and poly(trimethylene terephthalate) as disclosed in U.S. Pat. No. 6,232,400 to Harris et al. SURLYN®, LYCRA®, HYTREL®, DACRON®, KEVLAR®, ARAMID®, ORLON®, and QUINA®. fibers are available from E. I. DuPont de Nemours & Co. SPECTRA® fibers are available from the Honeywell Co. Cotton, rayon, acrylics, nylon, and polyester are particularly preferred fibers. As described above, a wide variety of material can be used to form the fiber flock. Polymeric materials that can be used to form the fiber flock include, for example, materials selected from the group consisting of polyurethane-polyurea copolymers, polyethylenes, polypropylenes, polyamides, polyethylene terephthalates, polyphenylene terephthalates, polyketones, and polyacrylonitriles.

The fiber flock (cut fiber or uncut tow) can be dyed to provide the desired colors. In some instances, the fiber is bleached before dying in order to obtain a full shade of the color. Finishing agents also may be applied in the dying process in order to produce fiber having desirable properties such as luster and a soft hand, stiffness so that it can be fed from the hopper onto the substrate, and good conductivity for elesctrostatic flocking. Multi-colored fiber flock also may be produced In general, the flocking process involves the steps of pretreating the core or other substrate surface of the golf ball (if needed); applying adhesive to the core or other substrate; applying fiber flock onto the adhesive-coated core or other substrate; performing a preliminary cleaning of the core or other substrate surface to remove excess flock fibers; drying and curing the adhesive; and performing a final cleaning of the core or other substrate surface.

The surface of the core or other substrate surface may be pre-treated to improve the adhesion of the fiber flock by using known techniques such as corona-discharge, plasma, fluorination, chlorination, and the like. Aqueous and non-aqueous based adhesives may be applied to the substrate. For example, acrylics, polyvinyl acetates (PVA), polyvinyl chlorides (PVC), styrene butadiene (SBR) and butadiene acrylonitrile (NBR), epoxies, and urethanes may be applied depending upon the type of fiber flock being applied and other desired properties. The adhesive may be applied using any suitable technique such as, for example, knife, roller, dipping, brushing, and spraying. Once the adhesive is applied to the substrate, the fiber flock should be directed onto the substrate immediately, so that the fiber can effectively penetrate the wet adhesive. Normally, the fiber flock is applied mechanically or electrostatically to the substrate.

One type of mechanical application uses a beater-bar, whereby the adhesive-coated substrate is passed over rotating rollers. The fiber flock is fed from a flock hopper onto the substrate. As the substrate passes over the rollers (beater-bars), it vibrates and this forces the applied fiber into the adhesive. The fiber penetrates the adhesive and becomes adhered to the substrate surface. A second type of method involves pneumatic flocking, whereby a directed airstream forces the flock onto the substrate. In electrostatic application, an electric charge is used to orient the fiber flock. In this method, the adhesive-coated substrate passes through a high voltage electrostatic field. An electrode is used to give the fiber flock a charge. The charged fibers become aligned with the electric field and are attracted to the grounded electrode. The fibers moves toward the adhesive-coated substrate and become embedded on the surface. The fibers are attached to the surface in a perpendicular direction providing the substrate with a dense, pile finish. The electrostatic flocking method can be used with pneumatic techniques for providing high fiber coverage.

Fiber flocking can be used to alter the surface properties of the substrate. For example, the fiber flock may be used to increase the surface area of the substrate and help promote wicking away of moisture. The flocked surfaces can be designed to either increase or decrease surface friction. The flocked fiber also can enhance sound and thermal insulation properties. For example, the flocked fiber may provide a protective and cushioning layer that helps to dampen noise and retains heat. The surface properties of the core or other substrate can be modified by using different types of fiber. The length, denier, and density of the fiber also can vary depending upon the intended end-use application.

The colored fiber flock can also provide special decorative effects. As discussed above, the fiber can be dyed to provide a wide variety of colors including deep and pastel shades. The fibers have high color vibrancy and brilliance to provide an appealing look. In addition, the fibers may have a glossy, semi-glossy, or matte-like surface finish.

While it is apparent that the illustrative embodiments of the invention disclosed herein fulfill the objectives of the present invention, it is appreciated that numerous modifications and other embodiments may be devised by those skilled in the art. Additionally, feature(s) and/or element(s) from any embodiment may be used singly or in combination with other embodiment(s) and steps or elements from methods in accordance with the present invention can be executed or performed in any suitable order. Therefore, it will be understood that the appended claims are intended to cover all such modifications and embodiments, which would come within the spirit and scope of the present invention.

What is claimed is:

1. A golf ball comprising a core, a composite inner cover layer, an intermediate layer disposed between the core and composite layer, and an outer cover layer surrounding the composite inner cover layer, wherein the composite layer and outer cover layer comprise a translucent polymer, and wherein fiber flock is embedded in the translucent polymer of the composite cover layer so the fiber is visible from the exterior of the ball.

2. The golf ball of claim 1, wherein the fiber flock composes fiber segments having lengths less than one inch.

3. The golf ball of claim 1, wherein the fiber flock comprises fiber segments having substantially equal dimensions.

4. The golf ball of claim 1, wherein the fiber flock is formed from a material selected from the group consisting of polyurethane-polyurea copolymers, polyethylenes, polypropylenes, polyamides, polyethylene terephthalates, polyphenylene terephthalates, polyketones and polyamionitriles.

5. The golf ball of claim wherein the composite layer further comprises reflective particulates.

6. The golf ball of claim 5, wherein the reflective particulates are selected from the group consisting of pearlescent pigments, metal flakes, iridescent glitter, metalized films, and colored polyester foils.

7. The golf ball of claim 6, wherein the reflective particulates are pearlescent pigments.

8. The golf ball of claim 7, wherein the pearlescent pigments are selected from the group consisting of metalized pigments, mica-based pigments, borosilicate pigments, titanium dioxide pigments, iron oxide pigments, and mixtures thereof.

9. The golf ball of claim 1, wherein the composite layer further comprises a colorant selected from dyes, pigments, and mixtures thereof.

10. The golf ball of claim 1, wherein the outer cover layer comprises reflective particulates.

11. The golf ball of claim 10 wherein the reflective particulates are pearlescent pigments.

12. The golf ball of claim 1, wherein the core comprises light-reflecting white pigment.

13. The golf ball of claim 1, wherein the core comprises light-absorbing colored pigment.

14. The golf ball of claim 1, wherein the core comprises at least one thermoset rubber material selected from the group consisting of polybutadiene, ethylene-propylene rubber, ethylene-propylene-diene rubber, poiyisoprene, styrene-butadiene rubber, polyalkenamers, butyl rubber, halobutyl rubber, polystyrene elastomers, copolymers of isobutylene and p-alkylstyrene, halogenated copolymers of isobutylene and p-alkylstyrene, copolymers of butadiene with acrylonitrile, polychloroprene, alkyl acrylate rubber, chlorinated isoprene rubber, acrylonitrile chlorinated isoprene rubber, and mixtures thereof.

15. The golf ball of claim 1, wherein the composite layer comprises at least one thermoplastic material selected from the group consisting of partially-neutralized ionomers; highly-neutralized ionomers; polyesters; polyamides; polyamide-ethers, polyamide-esters; polyurethanes, polyureas; fluoropolymers; polystyrenes; polypropylenes; polyethylenes; polyvinyl chiorides; polyvinyl acetates; polycarbonates; polyvinyl alcohols; polyester-ethers; polyethers; polyimides, polyetherketones, polyamideimides; and mixtures thereof.

16. The golf ball of claim 1 wherein the outer cover layer comprises a material selected from the group consisting of ionomers; polyurethanes, and polyureas.

* * * * *